US006559765B2

(12) United States Patent
Tsuzuki et al.

(10) Patent No.: US 6,559,765 B2
(45) Date of Patent: May 6, 2003

(54) INTEGRATED SECURITY SYSTEM COMPRISING A PLURALITY OF REMOTE-CONTROLLABLE SECURITY DEVICES AND ASSOCIATED CONTROL UNITS

(75) Inventors: Kazuhisa Tsuzuki, Secaucus, NJ (US); Motohiro Misawa, Yokohama (JP); Tooru Toyoda, Tokyo (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/749,289

(22) Filed: Dec. 28, 2000

(65) Prior Publication Data

US 2001/0030604 A1 Oct. 18, 2001

(30) Foreign Application Priority Data

Dec. 28, 1999 (JP) ..... 11-373018
Dec. 1, 2000 (JP) ..... 2000-367540

(51) Int. Cl.[7] ..... G08B 29/00

(52) U.S. Cl. ..... 340/506; 340/517; 340/518; 340/522; 340/524; 340/10.1; 340/538; 340/825.36

(58) Field of Search ..... 340/506, 517, 340/518, 522, 524, 10.1, 10.4, 511, 523, 514, 538, 825.36, 539

(56) References Cited

U.S. PATENT DOCUMENTS 3,792,470 A * 2/1974 Donovan et al. ..... 340/412
4,247,846 A * 1/1981 Zedler ..... 340/523
4,754,262 A * 6/1988 Hackett et al. ..... 340/525
5,448,320 A * 9/1995 Sakai et al. ..... 354/81
5,598,456 A * 1/1997 Feinberg ..... 379/42
5,736,927 A * 4/1998 Stebbins et al. ..... 340/506
5,923,363 A * 7/1999 Elberbaum ..... 340/310.01
5,936,941 A * 8/1999 Kondo et al. ..... 370/384
6,198,389 B1 * 3/2001 Buccola ..... 340/517
6,288,639 B1 * 9/2001 Addy ..... 340/539
6,337,621 B1 * 1/2002 Ogino et al. ..... 340/426

FOREIGN PATENT DOCUMENTS

JP 3-32239 2/1991
JP 6-37729 2/1994

* cited by examiner

*Primary Examiner*—Daniel J. Wu
*Assistant Examiner*—Daniel Previl
(74) *Attorney, Agent, or Firm*—Parkhurst & Wendel, L.L.P.

(57) ABSTRACT

An integrated security system includes a plurality of security devices each issuing an alarm signal. A plurality of control units are associated to control the security devices via a communication line. Each security device comprises an alarm storing section for storing alarm signals received from individual security devices as alarm information. An alarm transmitting section transmits the alarm information to all of the control units via the communication line. The alarm information stored in the alarm storing section during a predetermined storage time are transmitted at a time as an alarm notification command to the control units.

21 Claims, 8 Drawing Sheets

INTEGRATED SECURITY SYSTEM COMPRISING A PLURALITY OF REMOTE-CONTROLLABLE SECURITY DEVICES AND ASSOCIATED CONTROL UNITS

BACKGROUND OF THE INVENTION

The present invention relates to an integrated security system comprising a plurality of security devices and a plurality of control units connected via a communication line. More specifically, the present invention relates to improved and effective administration or control of alarm signals simultaneously or successively issued from individual security devices in such an integrated security system.

It is conventionally known that there are various buildings or facilities equipped with a plurality of monitor cameras installed at appropriate places therein. The image of each camera is displayed on a monitor television or recorded in a recording device (such as a video tape or a comparable recording medium). Such a monitoring or sensing system is generally known as a security system preferably employable for the purpose of preventing crimes or fires.

Japanese documents JP3-32239 and JP6-37729, both are published as unexamined Japanese patent application, disclose this kind of alarm monitoring systems.

Recent advancement of audio/video data communication techniques will soon make it possible to integrate a plurality of security systems which used to work independently. A plurality of control units will be incorporated in such an integrated security system. Each control unit can control other security devices as well as its own security device.

However, integrating numerous security devices will be subjected to a problem that an overall communication data amount of the system increases greatly due to various alarm signals to be generated from individual security devices each issued in case of detection of any suspicious mobile object or detection of any abnormality in respective security devices. Leaving such a congested situation of alarm signals or communication data will result in failure in transmission of control data.

SUMMARY OF THE INVENTION

In view of the foregoing problems, the present invention has an object to provide an integrated security system allowing a plurality of control units to flexibly control a plurality of security devices belonging to this integrated security system via communication lines.

Furthermore, the present invention has an object to provide an integrated or remote control security system which is capable of effectively administrating or controlling the alarm signals to be generated from individual security devices belonging to this integrated security system.

Moreover, the present invention has an object to provide an alarm processing method for the integrated security system.

To accomplish the above and other related objects, the present invention provides a first integrated security system comprising a plurality of security devices each issuing an alarm signal, a plurality of control units for controlling the security devices, and communication line means for allowing the security devices and the control units to perform data communication with each other. Each of the security devices comprises an alarm storing means for storing alarm signals received from individual security devices as alarm information, and an alarm transmitting means for transmitting the alarm information to all of the control units via the communication line means. All of the alarm information stored in the alarm storing means during a predetermined storage time are transmitted at a time as an alarm notification command to the control units.

With this arrangement, the received alarm signals are temporarily stored as the alarm information in the alarm storing means and all of the stored alarm information are transmitted at a time. Thus, the present invention makes it possible to constitute a reliable security system capable of effectively suppressing an overall communication amount even in circumferences where numerous alarm signals are simultaneously or successively issued.

According to a preferred embodiment, it is desirable that the security device has a storage timer which adjusts the storage time of the alarm information stored in the alarm storing means.

With this arrangement, it becomes possible to satisfy both realtime nature of alarm information and avoidance of alarm signal congestion. Thus, the present invention makes it possible to constitute a reliable security system capable of effectively suppressing an overall communication amount even in circumferences where numerous alarm signals are simultaneously or successively issued.

According to the preferred embodiment, it is desirable that the security device has a retransmission timer starting its counting operation in response to a transmission of the alarm notification command, and an alarm response receiving means for receiving an alarm response command returned from a designated control unit in response to the alarm notification command. The alarm transmitting means transmits the alarm notification command again when the alarm response receiving means does not receive the alarm response command within a retransmission time being set by the retransmission timer.

With this arrangement, when no alarm response command is returned in response to a transmitted alarm notification command, it is concluded that the system (i.e., the alarm transmitting means) fails in transmitting this alarm notification command to the control units. In such a case, the alarm notification command is transmitted again after passage of a predetermined time. Thus, the present invention makes it possible to accurately transmit the alarm notification command.

According to the preferred embodiment, it is desirable that each control unit receives the alarm notification command and broadcasts the alarm notification command to all of the security devices other than the specific security device which has transmitted the alarm notification command.

With this arrangement, the control device can notify an alarm notification command issued by one security device to other security devices.

Furthermore, the preset invention provides a remote control security system comprising at least one remote-controllable security device issuing an alarm signal and at least one control unit for controlling the remote-controllable security device. The remote-controllable security device and the control unit are allowed to perform data communication with each other via communication line means. The remote-controllable security device comprises alarm storing means for storing alarm signals received from the remote-controllable security device as alarm information, and alarm transmitting means for transmitting the alarm information to the control unit via the communication line means. All of the alarm information stored in the alarm transmitting means during a predetermined storage time are transmitted at a time as an alarm notification command to the control unit.

Furthermore, the present invention provides a second integrated security system comprising a plurality of security devices independently disposed in buildings or facilities to monitor or detect any suspicious mobile object or any abnormality appearing or occurring in the buildings or facilities. A plurality of control units are provided for remote-controlling the security devices via a communication line. An alarm storing means is provided for receiving alarm signals issued from individual security devices and for temporarily storing the received alarm signals as alarm information. A storage timer means is provided for designating a storage time during which the alarm storing means stores the received alarm signals. An alarm transmitting means is provided for transmitting all of the alarm information stored in the alarm storing means simultaneously as an alarm notification command to the control units via the communication line.

According to the preferred embodiment, it is desirable that an alarm response receiving means is provided for receiving an alarm response command returned from a designated control unit. The alarm response command is produced by the designated control unit as a response to the alarm notification command transmitted by the alarm transmitting means. It is checked based on the alarm response command whether the alarm transmitting means has succeeded or failed in transmitting the alarm notification command to the control units.

It is further desirable that a retransmission timer means is provided for designating a retransmission time of the alarm notification command. The alarm transmitting means transmits the alarm notification command again to the control units after passage of the designated retransmission time when the alarm transmitting means has failed in transmitting the alarm notification command.

Furthermore, the present invention provides a first alarm processing method for an integrated security system comprising at least one security device issuing an alarm signal and at least one control unit for controlling the security device via a communication line. The first alarm processing method comprising a step of receiving alarm signals from the security device, a step of storing the alarm signals temporarily as alarm information, and a step of transmitting all of the temporarily stored alarm information to the control unit at a time as an alarm notification command via the communication line.

Preferably, the step of transmitting the alarm notification command is interrupt processing performed at predetermined intervals.

The present invention provides a second alarm processing method for an integrated security system comprising at least one security device issuing an alarm signal and at least one control unit for controlling the security device via a communication line. The second alarm processing method comprising a step of receiving an alarm notification command transmitted from the security device, a step of producing an alarm response command responsive to the received alarm notification command, and a step of returning the alarm response command to the security device.

Preferably, the alarm response command includes a broadcast address so that the alarm response command can be transmitted to all of the security devices other than the specific security device which has transmitted the alarm notification command.

The present invention provides a third alarm processing method for an integrated security system comprising at least one security device issuing an alarm signal and at least one control unit for controlling the security device via a communication line. The third alarm processing method comprising a step of receiving an alarm response command returned from a designated control unit as a response to an alarm notification command having been transmitted based on an alarm signal issued by an arbitrary security device, and a step of retransmitting the alarm notification command after passage of a predetermined time when no alarm response command is received.

Preferably, a retransmit alarm list is provided to register each transmitted alarm information, and each registered alarm information is deleted when the alarm response command is received.

Preferably, the step of retransmitting the alarm notification command is interrupt processing performed at predetermined intervals.

Moreover, the present invention provides a fourth alarm processing method for an integrated security system comprising at least one security device issuing an alarm signal and at least one control unit for controlling the security device via a communication line. The fourth alarm processing method comprising a step of checking whether transmitting alarm information from an arbitrary security device to the control unit has succeeded or failed, and a step of retransmitting the alarm information from the arbitrary security device to the control in case of failure in transmitting the alarm information.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF A PREFERRED EMBODIMENT

Figure 1:
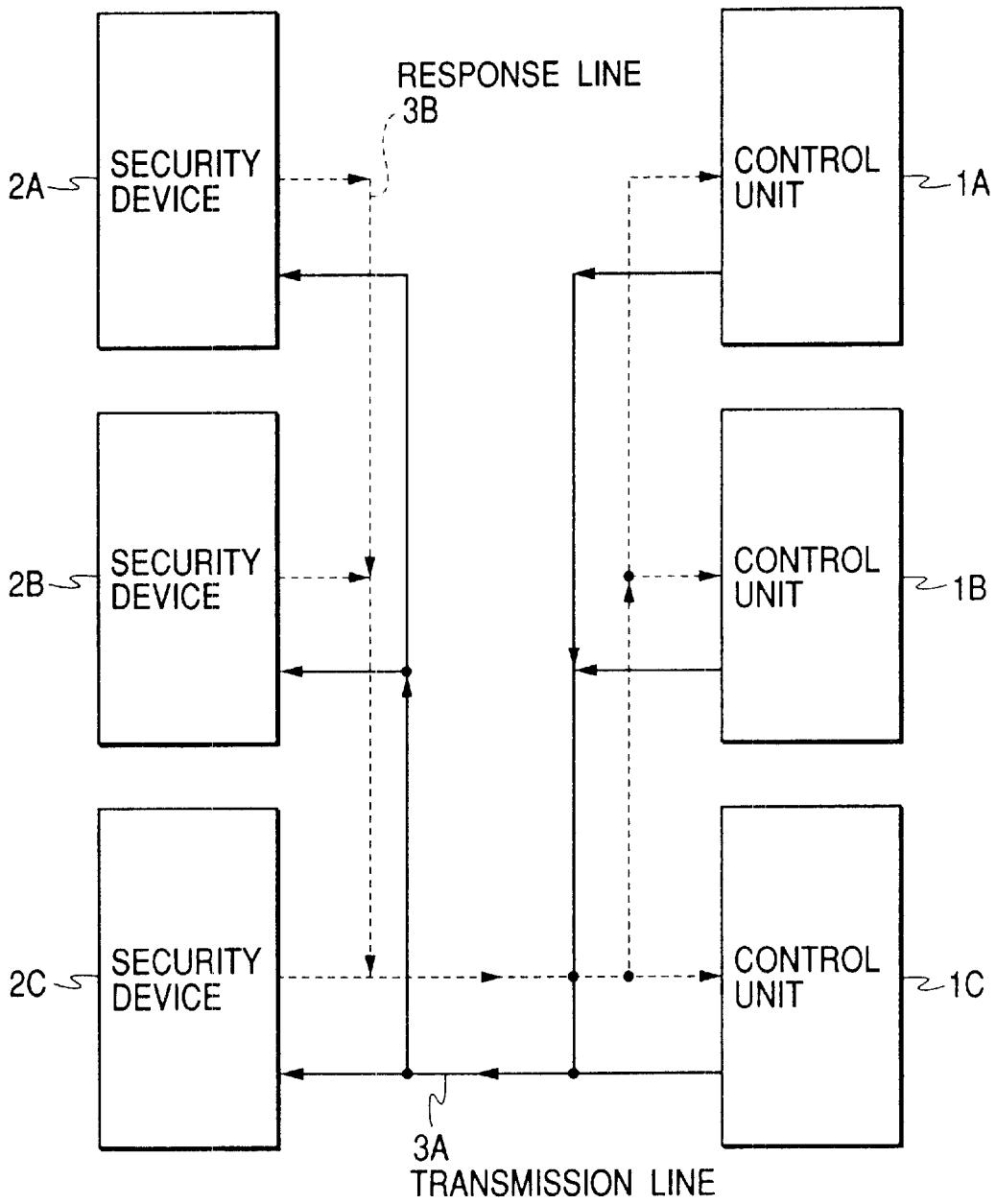
FIG. 1 is a block diagram showing an integrated security system in accordance with a preferred embodiment of the present invention.

Hereinafter, a preferred embodiment of the present invention will be explained with reference to the attached drawings. Identical parts are denoted by the same reference numerals throughout the views.

FIG. 1 is a block diagram showing an integrated security system in accordance with a preferred embodiment of the present invention. A plurality of control units 1A, 1B and 1C are connected to a plurality of security devices 2A, 2B and 2C via a transmission line 3A (indicated by a solid line) and a response line 3B (indicated by a dotted line). The security devices 2A, 2B and 2C are remote-controllable by the control units 1A, 1B and 1C, respectively.

The transmission line 3A is a communication line through which the control units 1A, 1B and 1C transmit control commands as well as alarm response commands to the security devices 2A, 2B and 2C. The response line 3B is a communication line through which the security devices 2A, 2B and 2C return response commands as well as alarm notification commands to the control units 1A, 1B and 1C.

Figure 11:
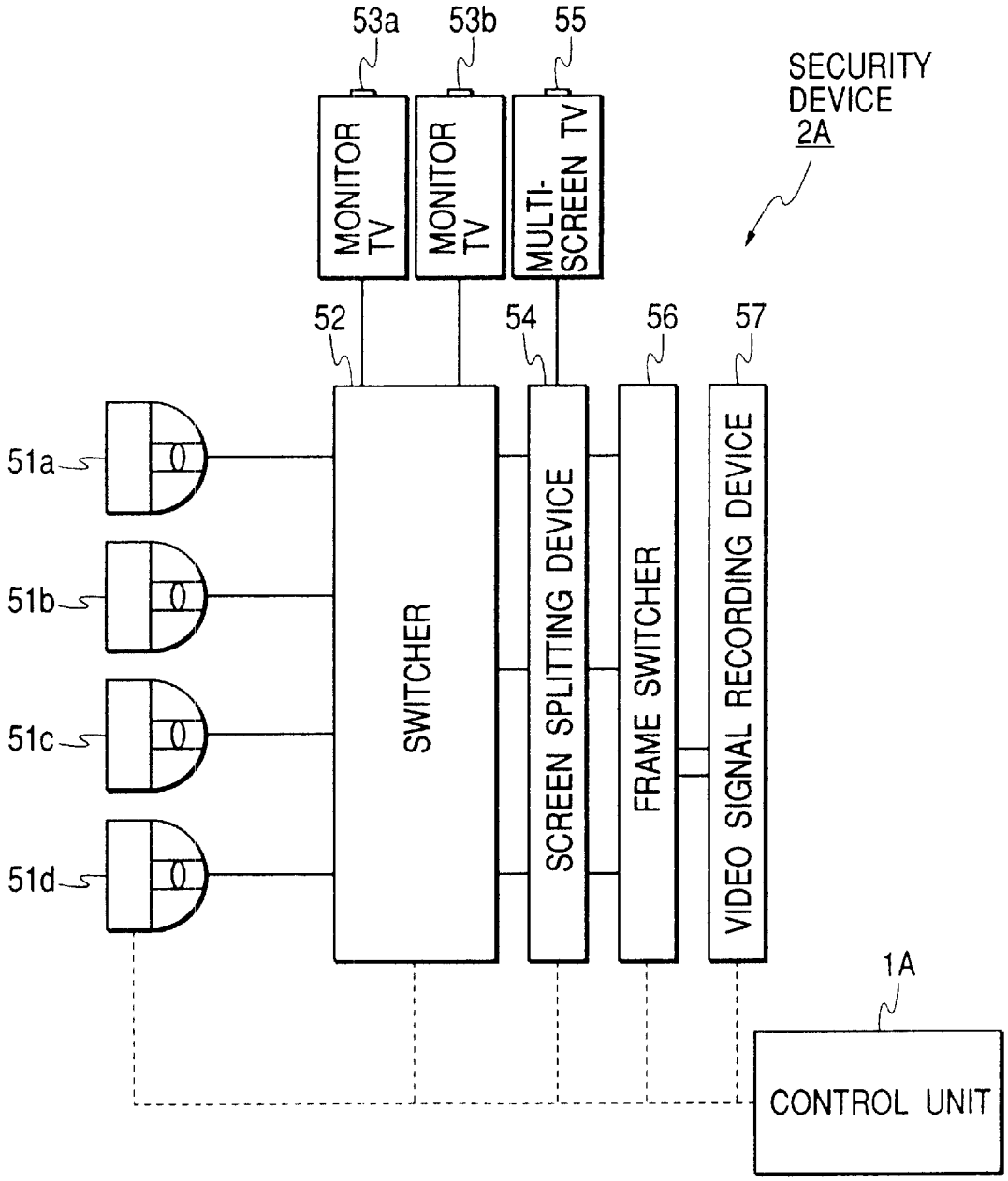
FIG. 11 is a block diagram showing an example of a security device incorporated in the integrated security system of the present invention.

FIG. 11 is a block diagram showing a detailed arrangement of the security device 2A which is controlled by the control unit 1A. The security device 2A comprises a plurality of monitor cameras 51*a* to 51*d*, a switcher 52, a plurality of monitor televisions 53*a*~53*b*, a screen splitting device 54, a multi-screen television 55, a frame switcher 56, and a video signal recording device 57. The multi-screen television 55 has a complex screen which is splittable into a plurality of small screen sections independently displaying the images taken by the monitor cameras 51*a* to 51*d*. The control unit 1A controls the monitor cameras 51*a* to 51*d*, the switcher 52, the screen splitting device 54, the frame switcher 56, and the video signal recording device 57.

More specifically, each of the monitor cameras 51*a* to 51*d* picks up the image of a designated monitoring area based on a control signal supplied from the control unit 1A. The monitor cameras 51*a* to 51*d* respectively produce video signals representing the picked up images. The switcher 52 selectively supplies the video signals of the monitor cameras 51*a*~51*d* to the monitor televisions 53*a*~53*b* based on a control signal supplied from the control unit 1A. Each of the monitor televisions 53*a*~53*b* receives a video signal selected by the switcher 52 and displays the image carried by this video signal on the screen thereof.

Furthermore, the video signals of the monitor cameras 51*a*~51*d* are sent to the screen splitting device 54 via the switcher 52. The screen splitting device 54 processes the received video signals to simultaneously display multiple images as split images on the multi-screen based on a control signal supplied from the control unit 1A. The screen splitting device 54 sends the processed video signals to the multi-screen television 55. The multi-screen television 55 has the capability of displaying a complex screen, according to which the screen can be flexibly split into a plurality of independent sub-screens. For example, the multi-screen television 55 provides a complex screen consisting of four sub-screens. So, the images carried by the video signals of the monitor cameras 51*a*~51*d* are simultaneously displayed on the corresponding sub-screens of the multi-screen television 55. The control unit 1A designates the positional relationship between each monitor camera and the position of a corresponding sub-screen which displays the image taken by this monitor camera.

Furthermore, the video signals of the monitor cameras 51*a*~51*d* are sent to the frame switcher 56 via the switcher 52 and the screen splitting device 54. The frame switcher 56 successively switches a plurality of video signals in the units of frame based on a control signal supplied from the control unit 1A. The video signal produced from the frame switcher 56 is stored in a recording medium (e.g., a video tape) accommodated in the video signal recording device 57.

Figure 2:
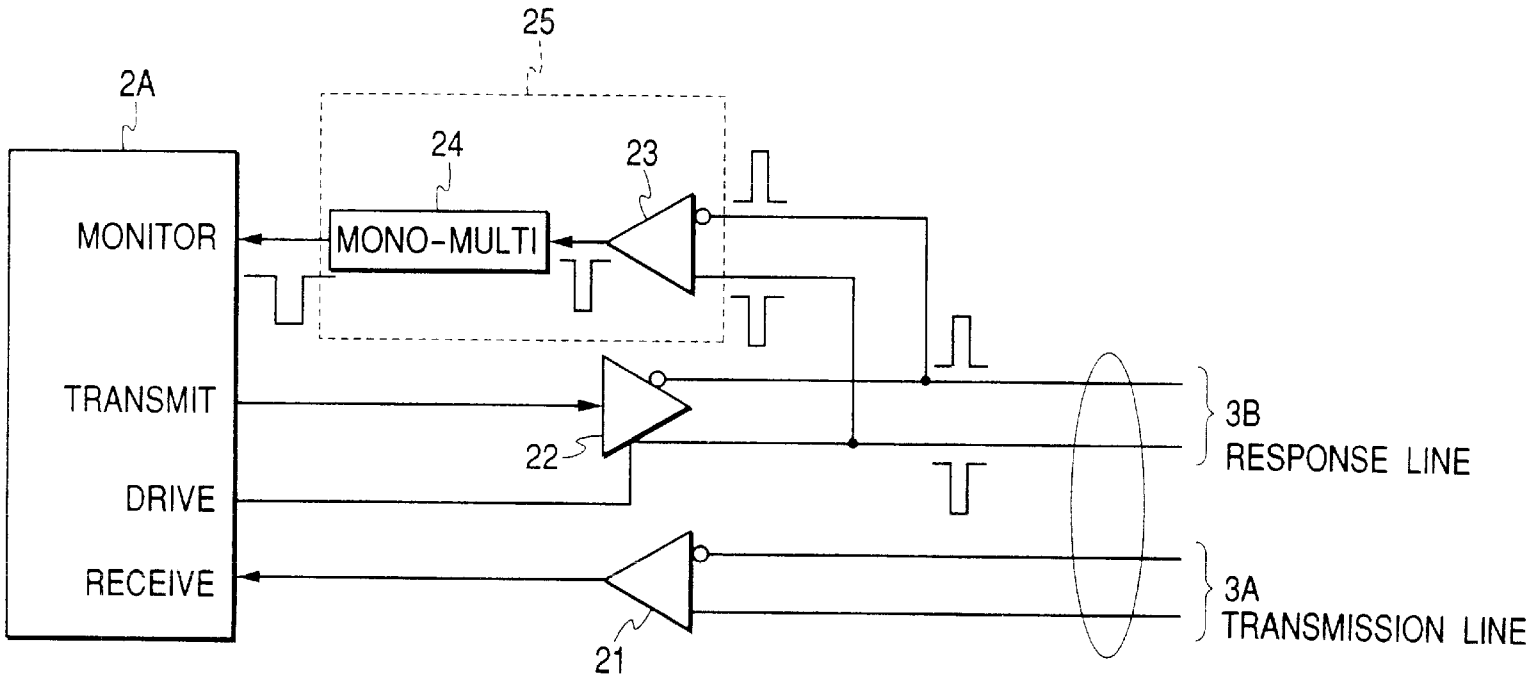
FIG. 2 is a block diagram showing an arrangement of a data input/output section of a security device in accordance with the preferred embodiment of the present invention.

FIG. 2 is a block diagram showing an arrangement of a data input/output section of the security device 2A. Of four communication lines available for the full-duplex transmission, two communication lines constitute the transmission line 3A and another two communication lines constitute the response line 3B. The transmission line 3A is connected to a receiving terminal of the security device 2A via a receiver 21. A transmitting terminal of the security device 2A is connected to the response line 3B via a driver 22.

Furthermore, the response line 3B is connected to a monitor terminal of the control unit 2A via a receiver 23 and a monostable multivibrator 24. The receiver 23 and the monostable multivibrator 24 cooperatively function as an information conflict detecting section 25. Other security devices 2B and 2C are structurally similar to the above-described security devices 2A. Furthermore, the control units 1A to 1C have data input/output sections substantially identical with the above-described data input/output section of the security device 2A.

Figure 3:
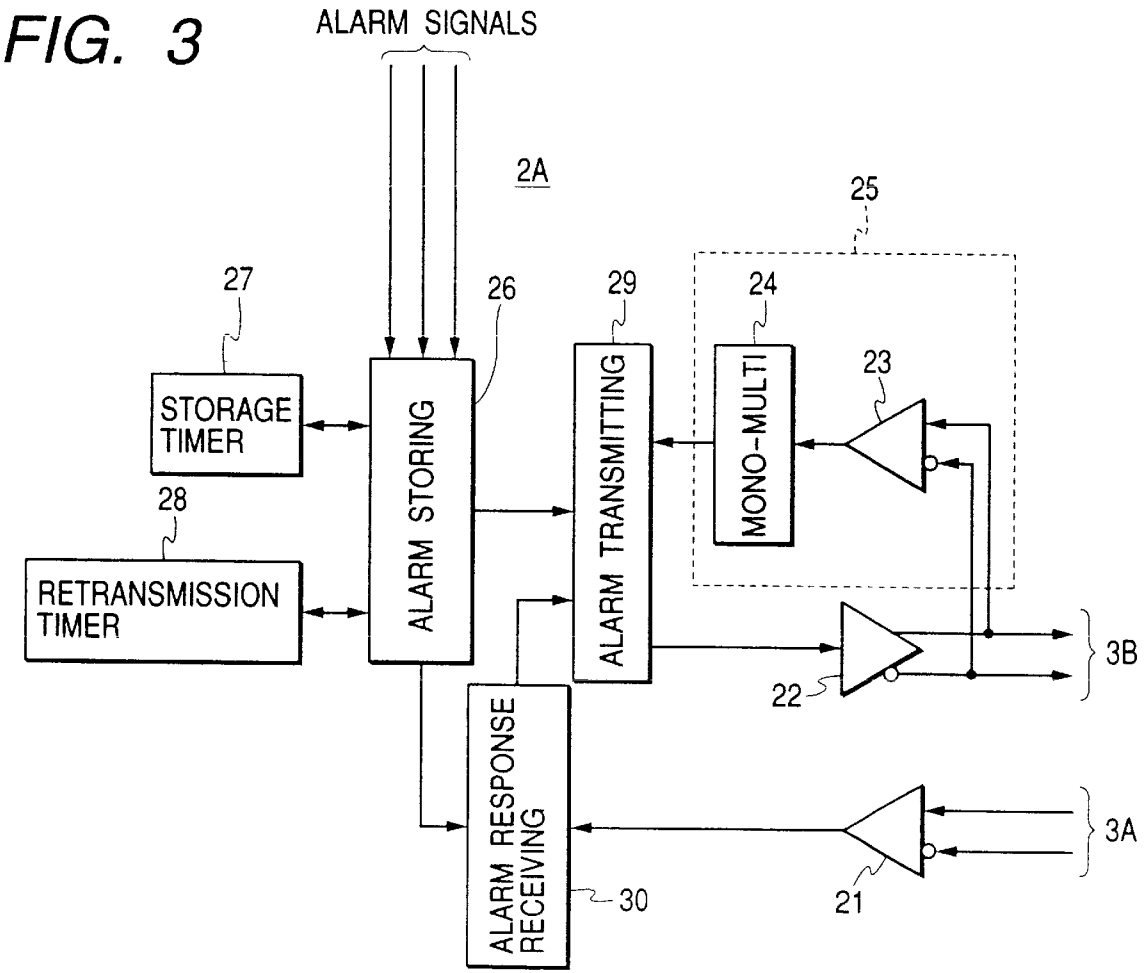
FIG. 3 is a block diagram showing an alarm processing arrangement of the security device in accordance with the preferred embodiment of the present invention.

FIG. 3 is a block diagram showing an alarm processing arrangement of the security device 2A. An alarm storing section 26 stores information of alarm signals entered into the alarm storing section 26. A storage timer 27 sets a storage time. The alarm storing section 26 temporarily stores received alarm information at intervals designated by the storage time. A retransmission timer 28 sets a retransmission time to an appropriate value. The alarm information stored in the alarm storing section 26 is re-transmitted after passage of the retransmission time. An alarm transmitting section 29 receives the alarm information from the alarm storing section 26 and transmits the received alarm information in the form of an alarm notification command through the response line 3B to the associated control units. An alarm response receiving section 30 receives an alarm response command sent via the transmission line 3A from the control unit. The security devices 2B and 2C have the same alarm processing arrangement as that of the security device 2A.

The input alarm signal is, for example, a mobile object detecting signal which is produced in response to detection of any mobile object appearing on an image taken by a monitor camera. The storage time for storing the alarm information is adjustable by the storage timer 27 to an appropriate value, for example, 0 sec., 1 sec., 5 sec. or any other appropriate value.

It is desirable to select the storage time=0 sec. in a situation where realtime nature of the alarm information is important. When the storage time is set to 0 sec., the alarm storing section 26 stores no alarm information and immediately transmits the received alarm information to the control unit via the response line 3B. To satisfy both realtime nature of alarm information and avoidance of alarm signal congestion, the storage time=1 sec. is practically desirable for an integrated security system including a total of 16 monitor cameras. The storage time=5 sec. will assure no congestion of alarm signals although the realtime nature may be sacrificed a little bit. Furthermore, this system provides an alarm-off mode which prohibits the output of alarm information. In the following description, it is assumed that the storage time of the storage timer 27 is set to 1 sec.

Figure 4:
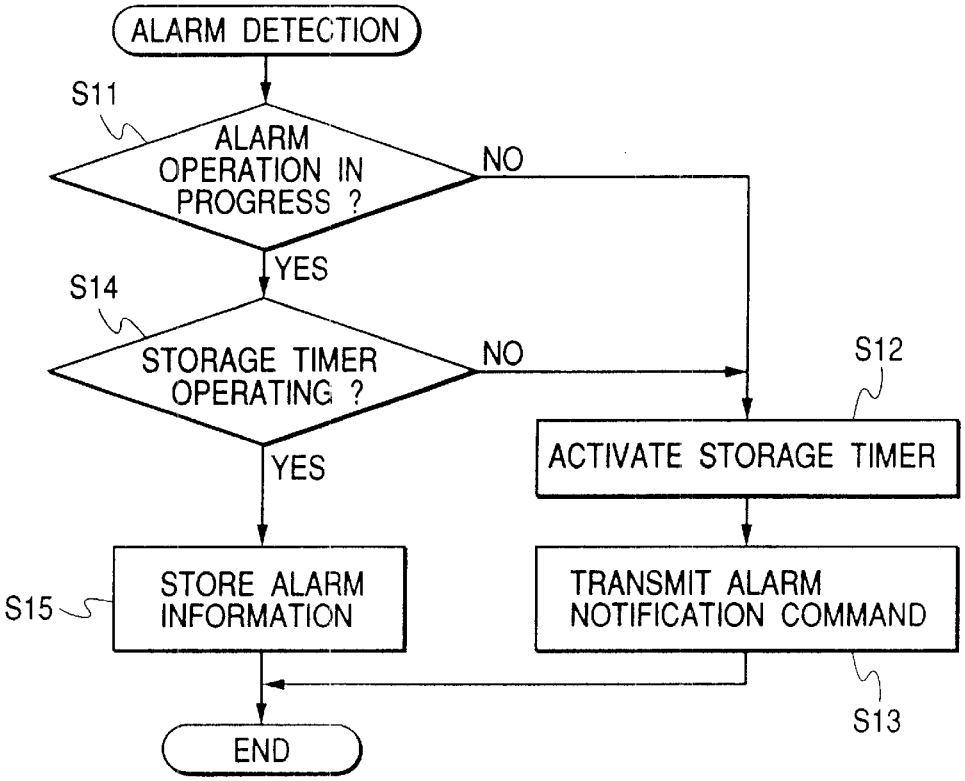
FIG. 4 is a flowchart showing a procedure for processing an alarm signal in accordance with the preferred embodiment of the present invention.

Next, an operation of the security system will be explained in accordance with the preferred embodiment of the present invention. FIG. 4 is a flowchart showing a procedure for processing an alarm signal entered in the alarm storing section 26 of the security device 2A.

An input alarm signal, such as a mobile object detecting signal, is entered in the alarm storing section 26 of the security device 2A. In response to reception of the input alarm signal, it is checked whether or not an alarm operation is now in progress (step S11). When the alarm operation is not executed (i.e., NO in the step S11), the storage timer 27 starts its counting operation in response to the alarm operation (step S12). Then, the alarm transmitting section 29 transmits an alarm notification command to the control units via the response line 3B (step S13).

When the alarm operation is in progress (i.e., YES in the step S11), it is further checked whether or not the storage timer 27 is now executing its counting operation (step S14). When the storage timer 27 is in a halt condition (i.e., NO in the step S14), the system causes the storage timer 27 to start its counting operation (step S12). When the counting operation is already in progress (i.e., YES in the step S14), the alarm storing section 26 stores alarm information (i.e., alarm signals) momently entered during a designated storage time (step S15).

When the designated storage time is up, transmission of the alarm information stored in the alarm storing section 26 is executed as interrupt processing.

Figure 5:
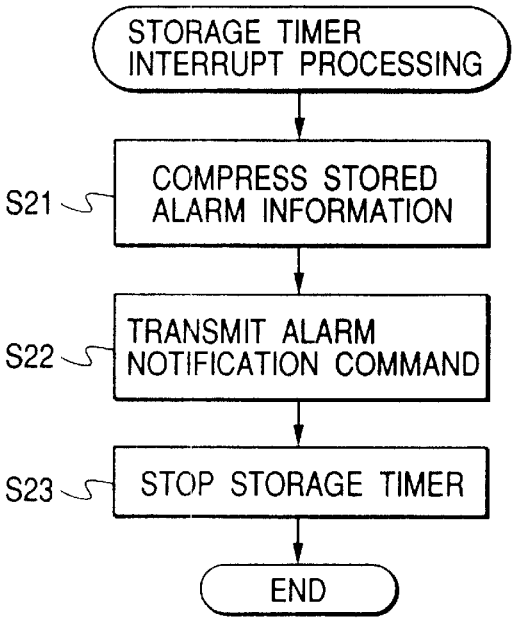
FIG. 5 is a flowchart showing interrupt processing executed when a storage time is up in accordance with the preferred embodiment of the present invention.

FIG. 5 is a flowchart showing the interrupt processing executed when the storage time is up.

The security device 2A starts the interrupt processing as soon as the storage time is up, and compresses the alarm information stored in the alarm storing section 26 (step S21). Then, the security device 2A transmits the compressed alarm information as an alarm notification command (step S22). After finishing the transmission of the alarm notification command, the security device 2A stops the counting operation and initializes the count value of the storage timer 27 (step S23). Then, this interrupt processing ends.

The alarm notification command has a format with a head portion and a content portion. An alarm identifier is positioned at the head portion, while a device identifier is placed in the content portion. The device identifier indicates a security device which has issued the alarm information. Accordingly, when the alarm information is generated several times during the storing time (e.g., 1 second), the content portion includes a plurality of device identifiers.

Transmission of the alarm notification command is performed under a condition that there are no response commands or no alarm notification commands sent out to the response line 3B from other security devices 2B and 2C. Thus, the security device 2A outputs the alarm notification command to the response line 3B only when no response commands or no other alarm notification commands exist on the response line 3B. The presence of any commands on the response line 3B can be confirmed with reference to on/off of a line monitor bit produced from the monostable multivibrator 24 of the information conflict detecting section 25. When the line monitor bit is on, at least one command generated from the security devices 2B and 2C is present. When the line monitor bit is off, no command exists on the response line 3B.

Figure 6:
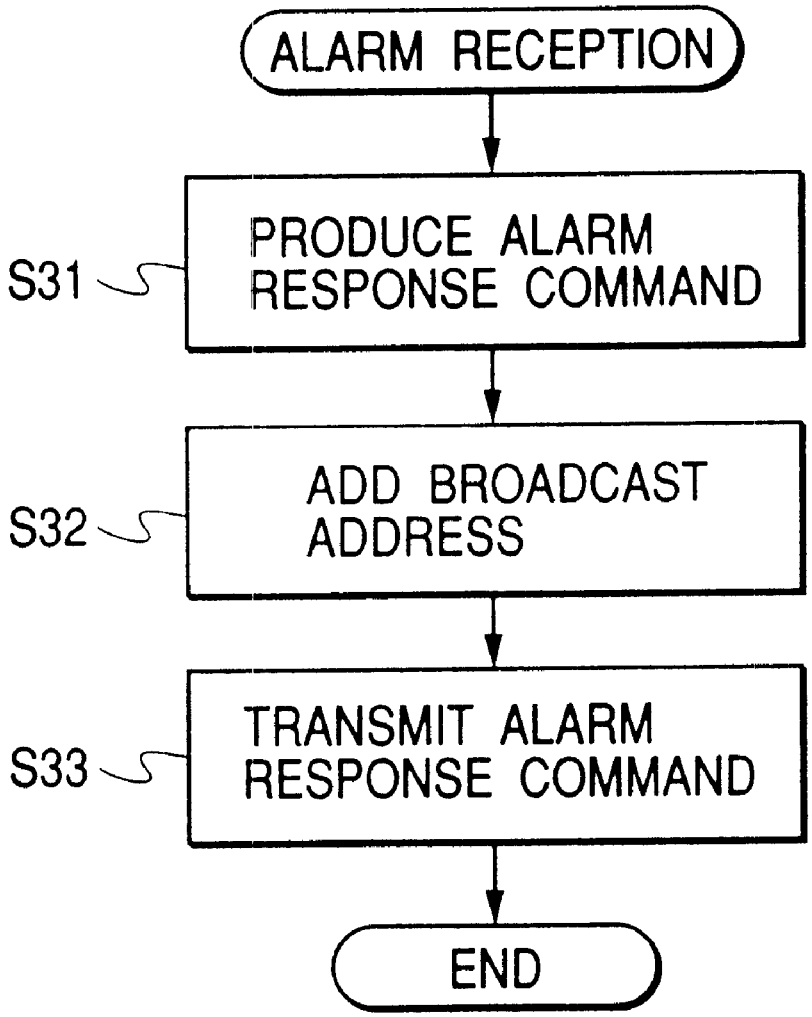
FIG. 6 is a flowchart showing an operation of a control unit for receiving and processing an alarm notification command in accordance with the preferred embodiment of the present invention.
Figure 7:
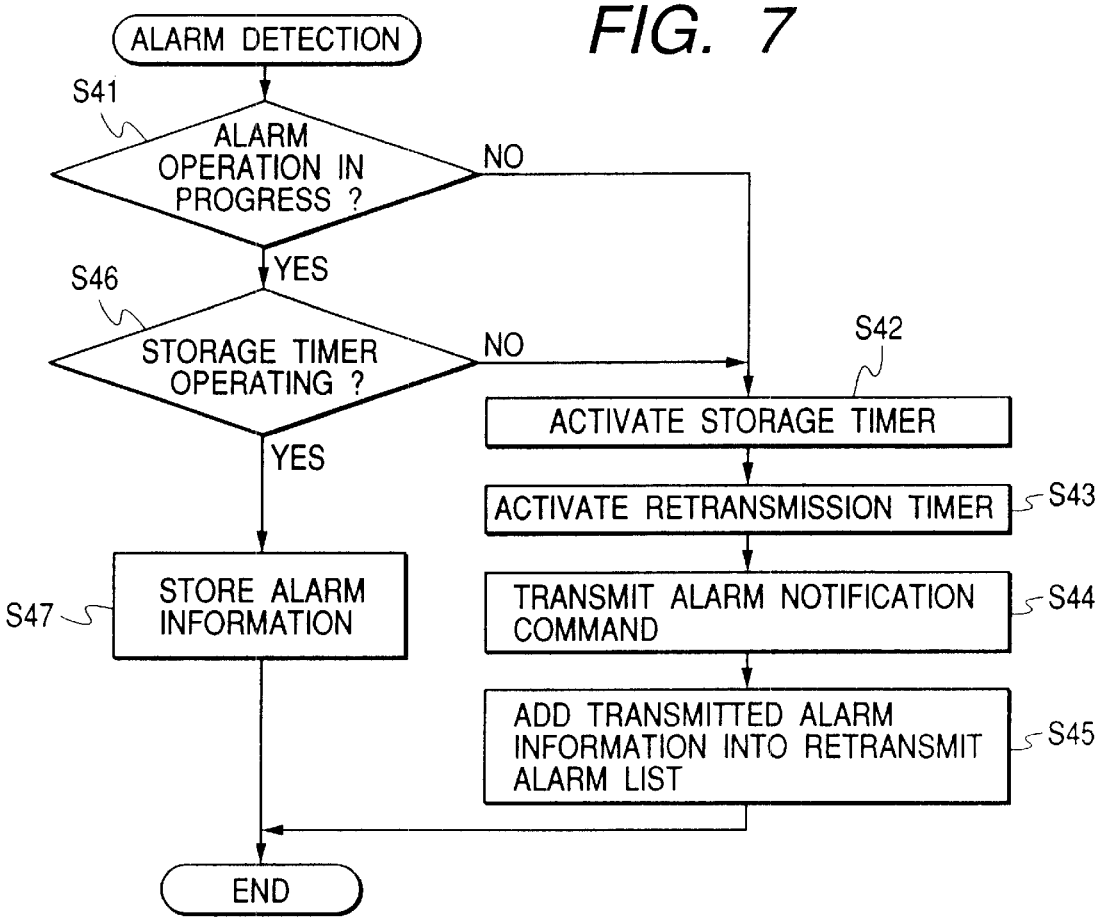
FIG. 7 is a flowchart showing an operation of the security device responsive to an alarm signal in accordance with the preferred embodiment of the present invention.

FIG. 6 is a flowchart showing an operation of the control unit for receiving and processing the alarm notification command.

The alarm notification command produced from each security command is equally sent to all of the control units. When each control unit confirms its own address attached to the alarm notification command, the condition of this control unit transfers to an alarm condition where an alarm LED flickers. The address attached to the alarm notification command may be a group address identifying a plurality of addresses of the security devices belonging to the same group. In this case, all of the control units designated by the group address are brought into the alarm condition.

Returning an alarm response to the security device is performed by using only one control unit. For example, it is assumed that the control unit 1A having a private address "1" performs the alarm response processing. First, the control unit 1A receives the alarm notification command from the security device 2A, and then generates an alarm response command in response to this alarm notification command (step S31). Next, to notify the alarm notification command issued by the security device 2A to other security devices 2B~2C, the control unit 1A adds a broadcast address to the alarm response command (step S32). The broadcast address is used for simultaneous communications. Then, the control unit 1A outputs the alarm response command to the transmission line 3A (step S33). Thus, an alarm issued by any one of a plurality of security devices 2A to 2C is transmitted to all of the remaining security devices by means of the alarm response command.

The security device 2A has a retransmission function which is explained hereinafter with reference to flowcharts shown in FIGS. 7 to 10.

First, in response to reception of an alarm signal, the alarm storing section 26 of the security device 2A makes a judgement as to whether or not an alarm operation is now in progress (step S41). When the alarm operation is not executed (i.e., NO in the step S41), the storage timer 27 starts its counting operation (step S42) and the retransmission timer 28 starts its counting operation (step S43). Then, the alarm transmitting section 29 transmits an alarm notification command to the control units 1A to 1C via the response line 3B (step S44). Then, the transmitted alarm information is added or registered into a retransmit alarm list (S45).

When the alarm operation is in progress (i.e., YES in the step S41), it is further checked whether or not the storage timer 27 is now executing its counting operation (step S46). When the storage timer 27 is in a halt condition (i.e., NO in the step S46), the system causes the storage timer 27 to start its counting operation (step S42). When the counting operation is already in progress (i.e., YES in the step S46), the alarm storing section 26 stores alarm information (step S47).

When the designated storing time is up, transmission of the alarm information stored in the alarm storing section 26 is executed as interrupt processing.

Figure 8:
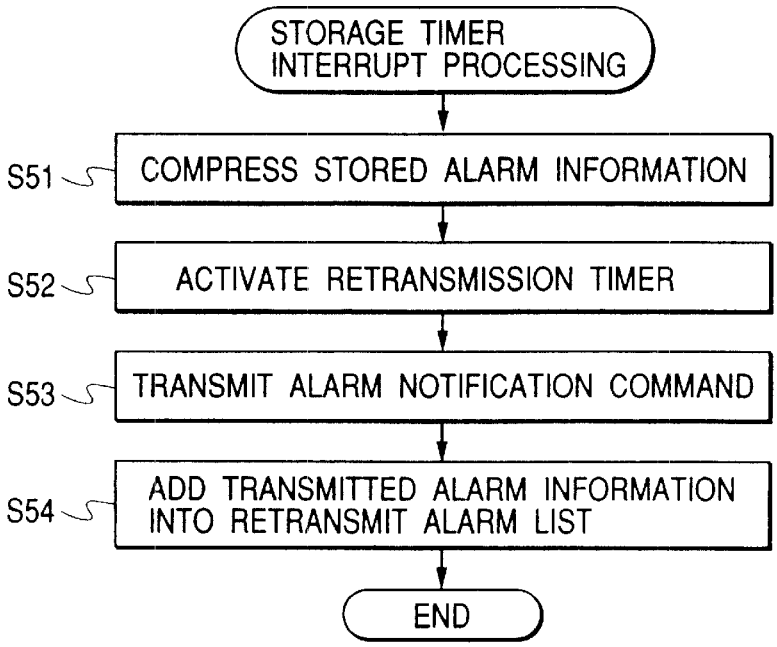
FIG. 8 is a flowchart showing interrupt processing executed when the storage time is up in accordance with the preferred embodiment of the present invention.

FIG. 8 is a flowchart showing the interrupt processing executed when the storage time is up.

The security device 2A starts the interrupt processing as soon as the storage time is up, and compresses the alarm information stored in the alarm storing section 26 (step S51). Then, the security device 2A activates the retransmission timer 28 to start its counting operation (step S52). the security device 2A transmits the compressed alarm information as the alarm notification command (step S53). Then, the security device 2A adds or register the transmitted alarm information into a retransmit alarm list (step S54).

When the control unit 1A receives an alarm notification command, the control unit 1A returns the above-described alarm response command. This alarm response command is received by the alarm response receiving section 30 of the security device 2A.

Figure 9:
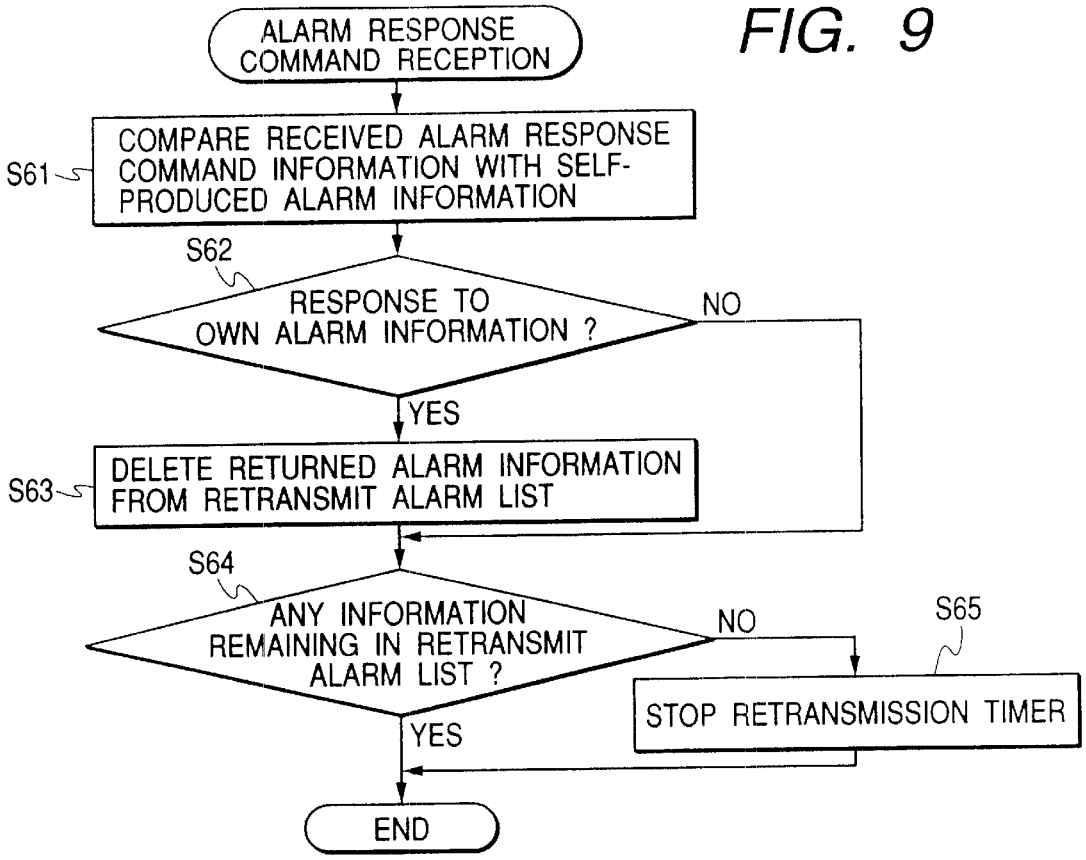
FIG. 9 is a flowchart showing a procedure for receiving an alarm response command in accordance with the preferred embodiment of the present invention.

FIG. 9 is a flowchart showing an operation of the security device 2A for receiving the alarm response command.

First, the security device 2A makes a judgement as to whether or not the received alarm response command is a response to the own (i.e., self-produced) alarm notification command transmitted by this security device 2A (steps S61 and S62). This judgement is performed by checking the information stored in the content portion of the alarm response command. The content portion of the alarm response command includes an attribute of this command which identifies a specific security device to which this alarm response should be returned.

When the received alarm response command is a response to the own alarm notification command transmitted by this security device 2A (i.e., YES in step S62), it is concluded that the own alarm notification command has been successfully transmitted. The security device 2A deletes the received alarm information from the retransmit alarm list (step S63). When the received alarm response command is a response to an alarm notification command not transmitted by this security device 2A (i.e., NO in step S62), the security device 2A skips the processing of step S63. Next, it is judged whether there is any information remaining in the retransmit alarm list (step S63). When any information remains (i.e., YES in step S64), the security device 2A terminates this processing. When no information remains (i.e., NO in step S64), the security device 2A stops the retransmission timer 28 (step S65) and then terminates this processing.

Figure 10:
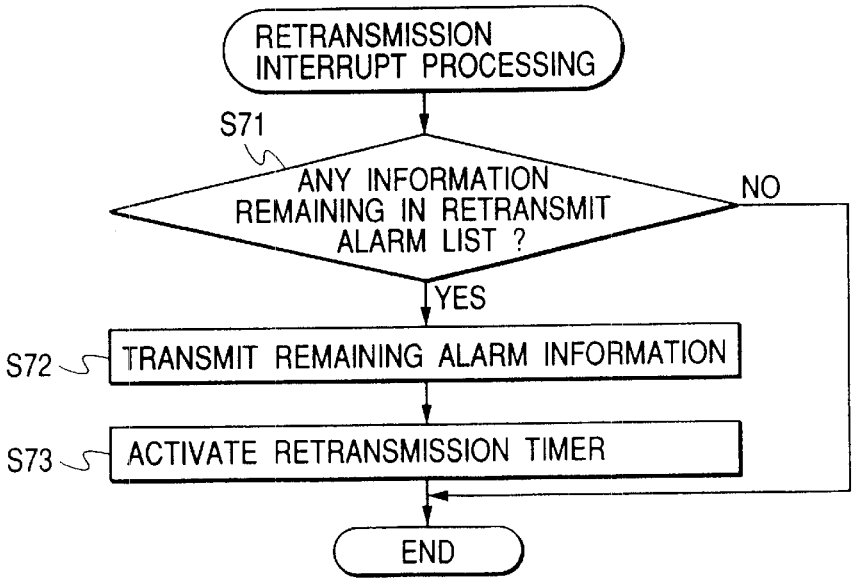
FIG. 10 is a flowchart showing interrupt processing executed when a retransmission time is up in accordance with the preferred embodiment of the present invention.

When a designated retransmission time is up, the security device 2A starts the interrupt processing as shown in the flowchart of FIG. 10. First, it is judged whether or not any alarm information remains in the retransmit alarm list (step S71). When no alarm information remains in the retransmit alarm list (i.e., NO in the step S71), the security device 2A terminates this interrupt processing.

When any alarm information remains in the retransmit alarm list (i.e., YES in the step S71), it means that the alarm response command has not been received for a transmitted alarm notification command. Thus, it is concluded that the security device 2A has failed in transmitting the alarm notification command. Hence, the alarm information remaining in the retransmit alarm list is transmitted again (step S72). The retransmission timer S73 is activated to re-start its counting operation (step S73). Then, this interrupt processing is terminated. For example, it is preferable to fix the retransmission time of the retransmission timer 28 to 5 seconds. It is also preferable to limit allowable repetition of the retransmitting operation to three times.

The above-described processing can be equally realized in another integrated security system constituted by a combination of a single security device and a plurality of control units, or by a combination of a plurality of security devices and a single control unit, or even by a combination of a single security device and a single control unit. Similar processing can be performed when a plurality of alarms are simultaneously or successively issued from a plurality of security devices.

As described above, the present invention is preferably applied to an integrated security system comprising a plurality of security devices and a plurality of control units which are connected via communication lines. According to the present invention, alarm signals received during a predetermined storage time are temporarily stored and then all of the stored alarm information are transmitted as alarm information at a time. Thus, the present invention provides an excellent and reliable security system which is capable of avoiding conflict of alarm information which may arise when a plurality of alarm signals are simultaneously or successively produced from individual security devices.

This invention may be embodied in several forms without departing from the spirit of essential characteristics thereof. The present embodiment as described is therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. An integrated security system comprising:

a plurality of security devices each for issuing an alarm signal;

a plurality of control units for controlling said security devices; and means for communicating between said security devices and said control units;

wherein each of said security devices comprises:

means for storing alarm signals received from other said security devices as alarm information; and means for transmitting said alarm information to all control units via said communication means, and for transmitting all of the alarm information stored in said alarm storing means during a predetermined storage time at a predetermined transmission time as an alarm notification command to said control units.

2. The integrated security system in accordance with claim 1, wherein said each security device comprises a storage timer for adjusting said storage time of said alarm information stored in said alarm storing means.

3. The integrated security system in accordance with claim 1, wherein said each security device comprises a retransmission timer for starting a counting operation in response to a transmission of said alarm notification command, and means for receiving an alarm response command returned from a designated control unit in response to said alarm notification command, and said alarm transmitting means is for transmitting said alarm notification command again when said alarm response receiving means does not receive said alarm response command within a retransmission time set by said retransmission timer.

4. The integrated security system in accordance with claim 1, wherein each control unit is for receiving said alarm notification command and is for broadcasting said alarm notification command to all of the security devices other than said specific security device which has transmitted said alarm notification command.

5. A remote control security system comprising:

at least one remote-controllable security device issuing an alarm signal;

at least one control unit for controlling said at least one remote-controllable security device; and means for communicating between said at least one remote-controllable security device and said at least one control unit, wherein said at least one remote-controllable security device comprises:

means for storing alarm signals received from said at least one remote-controllable security device as alarm information; and means for transmitting said alarm information to said at least one control unit via said communication means, and for transmitting all of the alarm information stored in said alarm transmitting means during a predetermined storage time at a predetermined transmission time as an alarm notification command to said at least one control unit.

6. The remote control security system in accordance with claim 5, wherein said at least one remote-controllable security device comprises a storage timer for adjusting said storage time of said alarm information stored in said alarm storing means.

7. The remote control security system in accordance with claims 5, wherein said at least one remote-controllable security device comprises a retransmission timer for starting a counting operation in response to a transmission of said alarm notification command, and a receiving means for receiving an alarm response command returned from a designated control unit in response to said alarm notification command, and said alarm transmitting means is for transmitting said alarm notification command again when said alarm response receiving means does not receive said alarm response command within a retransmission time set by said retransmission timer.

8. An integrated security system comprising:

a plurality of security devices independently located in buildings or facilities to monitor or detect any suspicious mobile object or any abnormality appearing or occurring in said buildings or facilities;

a plurality of control units for remote-controlling said security devices via a communication line;

alarm storing means for receiving alarm signals issued from said plurality of security devices and for temporarily storing the received alarm signals as alarm information;

storage timer means for designating a storage time for said alarm storing means to store said received alarm signals; and means for transmitting all of said alarm information stored in said alarm storing means simultaneously as an alarm notification command to all said control units via said communication line.

9. The integrated security system in accordance with claim 8, further comprising:

means for receiving an alarm response command returned from a designated control unit, said alarm response command produced by said designated control unit as a response to said alarm notification command transmitted by said alarm transmitting means, and means for checking, based on said alarm response command, whether said alarm transmitting means has succeeded or failed in transmitting said alarm notification command to said control units.

10. The integrated security system in accordance with claim 9, further comprising retransmission timer means for designating a retransmission time of said alarm notification command, wherein said alarm transmitting means is for transmitting said alarm notification command again to said control units after passage of said designated retransmission time when said alarm transmitting means has failed in transmitting said alarm notification command.

11. The integrated security system in accordance with claim 10, wherein said retransmission timer means also is for adjusting said retransmission time.

12. The integrated security system in accordance with claim 8, wherein said storage timer means also is for adjusting said storage time.

13. The integrated security system in accordance with claim 8, wherein each control unit is for receiving said alarm notification command and is for broadcasting said alarm notification command to security devices which have issued no alarm signal.

14. An alarm processing method for an integrated security system comprising at least one security device for issuing an alarm signal and at least one control unit for controlling said at least one security device via a communication line, said alarm processing method comprising:

receiving alarm signals from said at least one security device;

storing said alarm signals temporarily as alarm information during a predetermined storage time; and transmitting all of said temporarily stored alarm information to said at least one control unit at a predetermined transmission time as an alarm notification command via said communication line.

15. The alarm processing method in accordance with claim 14, wherein transmitting said alarm notification command is interrupt processing performed at predetermined intervals.

16. The alarm processing method for an integrated security system in accordance with claim 14, further comprising:

receiving an alarm response command returned from a designated control unit as a response to an alarm notification command having been transmitted based on an alarm signal issued by an arbitrary security device; and retransmitting said alarm notification command after passage of a predetermined time when no alarm response command is received.

17. The alarm processing method in accordance with claim 16, further comprising registering each transmitted alarm information with a retransmit alarm list; and deleting each registered alarm information when said alarm response command is received.

18. The alarm processing method in accordance with claim 16, wherein retransmitting said alarm notification command comprises interrupt processing performed at predetermined intervals.

19. The alarm processing method for an integrated security system in accordance with claim 14, further comprising:

checking whether transmitting alarm information from an arbitrary security device to said at least one control unit has succeeded or failed; and retransmitting said alarm information from said arbitrary security device to said at least one control when transmitting said alarm information has failed.

20. An alarm processing method for an integrated security system comprising at least one security device for issuing an alarm signal and at least one control unit for controlling said at least one security device via a communication line, said alarm processing method comprising:

receiving an alarm notification command transmitted at a predetermined transmission time from said at least one security device, said alarm notification command including all of temporarily stored alarm information stored during a predetermined storage time;

producing an alarm response command responsive to said received alarm notification command; and returning said alarm response command to said at least one security device.

21. The alarm processing method in accordance with claim 20, wherein said alarm response command comprises a broadcast address so that said alarm response command is transmitted to all of the security devices other than said specific security device which has transmitted said alarm notification command.

* * * * *